US005159961A

United States Patent [19]

Snetting et al.

[11] Patent Number: 5,159,961

[45] Date of Patent: Nov. 3, 1992

[54] INFLATOR/DEFLATOR ACCESSORY FOR AIR COMPRESSOR

[75] Inventors: Mark E. Snetting; Steven A. Anderson, both of Eden Prairie, Minn.; Scott D. Price, Pylesville; David L. Sutton, Forest Hill, both of Md.

[73] Assignee: Black & Decker Inc., Newark, Del.

[21] Appl. No.: 608,516

[22] Filed: Nov. 2, 1990

[51] Int. Cl.[5] ..... F04F 5/44; B65B 3/14

[52] U.S. Cl. ..... 141/10; 141/7; 141/65; 141/114; 5/453; 137/223; 441/91; 417/151

[58] Field of Search ..... 417/151, 181, 190; 141/1, 10, 7, 5, 38, 65, 67, 114; 5/453; 137/223; 441/91, 40

[56] References Cited

U.S. PATENT DOCUMENTS 1,943,187 1/1934 Re Vley et al. .
2,740,609 4/1956 Richardson et al. .
3,466,157 5/1969 Schafer ..... 417/181
3,563,674 2/1971 Moffat et al. ..... 417/151 X
4,597,716 7/1986 Evenson ..... 417/181
4,678,014 7/1987 Owen et al. .

FOREIGN PATENT DOCUMENTS 2461539 7/1976 Fed. Rep. of Germany ..... 417/151
7925382 4/1982 Fed. Rep. of Germany .

*Primary Examiner*—Ernest G. Cusick
*Attorney, Agent, or Firm*—Dennis A. Dearing; John D. Del Ponti; Charles E. Yocum

[57] ABSTRACT

An accessory for inflating and deflating inflatable articles comprises a conduit 13, an intake 17, an outtake 19 and an injector 35. In use, conduit 13 functions as a venturi tube for rapid inflation and deflation of inflatable articles, preferably, articles having a large, low pressure air volume. For inflation, outtake 19 is connected to the inflatable article. For deflation, intake 17 is connected to the inflated article. For inflation and deflation, a source of pressurized air, preferably, an electric air compressor is connected to injector 35.

31 Claims, 6 Drawing Sheets

INFLATOR/DEFLATOR ACCESSORY FOR AIR COMPRESSOR

FIELD OF THE INVENTION

This invention relates to a device for inflating and deflating low pressure inflatable articles and a method for using the device for inflation and deflation of such articles. More particularly, the device is intended for use with a source of pressurized air such as an electric air compressor to increase the airflow for rapid inflation and deflation of an article.

BACKGROUND OF THE INVENTION

Electric air compressors are commonly used to inflate a wide range of consumer articles such as tires, air mattresses, rafts, swimming pools and balls. The suitability of an air compressor for such applications is determined primarily by two criteria, the airflow rate and the maximum pressure developed by the compressor. These criteria determine whether the compressor is capable of inflating the article to the desired pressure and the length of time required to inflate the article to the desired pressure. Consumer air compressors cannot be cost effectively designed to rapidly inflate articles having a wide range of air volumes and internal air pressures. Therefore, the design of consumer air compressors must be a compromise.

One application for which most consumer air compressors do not provide efficient inflation is articles having a large air volume and a relatively low air pressure such as air mattresses. For example, an air mattress which is 58"×77"×8" in size has an air volume of approximately 21 cubic feet at 0.1 psig. air pressure. To inflate such a mattress with one commercially available air compressor, which is rated at 1.0 cubic feet per minute (cfm) at 30 pounds per square inch (psi), approximately 16.5 minutes are required. It would, of course, be desirable to provide a low cost accessory for a compressor for reducing the inflation time.

In addition to time consuming inflation, another problem arising from the use of high air volume, low pressure inflatable articles is that there is no efficient means of deflating the article for storage or transport. Thus it would be desirable to provide a low cost accessory for a compressor for rapidly deflating an article.

Accordingly, the primary object of this invention is to provide an accessory for a pressurized air source, (preferably, an air compressor) for inflating and deflating high volume, low pressure articles and a method for using the accessory for inflating and deflating such articles. Still another object is to provide an accessory which is rapidly and easily convertable between an accessory for inflating an article and an accessory for deflating an article.

SUMMARY OF THE INVENTION

In accordance with one aspect of the invention, as embodied and described herein, a device for inflating and deflating inflatable articles comprises a conduit having a sidewall, an intake and an outtake. A tubular injector is fixed to and extends through the sidewall. The injector has an opening external to the sidewall which is connectable to a source of pressurized air and has a small orifice within the conduit for expelling a small volume, high velocity, low pressure air stream. An air inlet is provided in the sidewall. A closure or the inlet is movable between an open position for permitting airflow through the inlet and a closed position for preventing airflow through the inlet.

The conduit operates as a venturi tube. For inflation of an article, the outtake is connected to the article and air is drawn in through the inlet and the intake. The provision of an air inlet in addition to an air intake, provides enhanced airflow for more rapid inflation. For deflation, the air inlet is closed and the intake is connected to the inflated article to be deflated. Rapid and complete deflation of the article may be achieved in this manner.

The closure preferably comprises a first section of the conduit and a second section of the conduit coaxially overlapping the first section and rotatable relative to the first section for opening and closing the inlet.

To guide the relative rotation, a tongue and groove connection is preferably provided between the sections. The tongue and groove connection may also incorporate a stop for limiting relative rotation to define open and closed positions of the closure.

To adapt the size of the outtake of the conduit to fit in inflatable articles for a variety of sizes of fill valves, an adapter nozzle, which terminates in an appropriate size to fit the fill valve, may be connected to the outtake.

In accordance with another aspect of the invention, the closure serves as a means for adjusting the size of the intake to convert the device back and forth between inflation an deflation modes. In one embodiment, the closure means is constituted by first and second sections of the conduit which are relatively rotatable to adjust the size of the intake. In an alternate embodiment, the closure means is constituted by first and second sections of the conduit which are detachably connectable to adjust the size of the intake.

In accordance with another aspect of the invention, the method for using the device described above for inflation comprises three primary steps. The first step is to connect the outtake of the conduit to a fill valve of the article. The second step is to generate a small volume, high velocity, low pressure air stream from the orifice of the injector toward the outtake. The third step is to generate a high volume, low pressure air stream which is taken in through the intake and inlet, is transmitted through the passageway of the conduit and is expelled into the article from the outtake. If the intake is not initially opened, the closure for the inlet is moved to an open position. In this manner, rapid inflation of the article may be achieved. Incoming air for inflating the article is sourced from the injector, the intake and the inlet. The provision of the inlet provides greatly enhanced airflow to reduce inflation time.

To increase the maximum pressure to which the article may be inflated, the intake and the inlet may be closed to increase the pressure within the conduit. With the intake and inlet closed, the article is now inflated through air sourced only from the injector. Preferably the inlet is closed by relatively rotating the first and second sections of the conduit to misalign the apertures in the sections. The intake is preferably closed by covering it with a finger.

In accordance with another aspect of the invention, the method for deflating the article comprises four primary steps. The first step is to connect the intake to the fill valve of the article. The second step is to close the air inlet. The third step is to generate a small volume, high velocity, low pressure air stream from the orifice toward the outtake. The fourth step is to generate a high volume, low pressure air stream which is expelled from the article through the intake, is transmitted through the passageway and is expelled from the outtake into the article.

The intake is preferably connected to the fill valve of the article by inserting an adapter nozzle over the intake and inserting the nozzle into the fill valve of the article.

As will be appreciated, the device may be conveniently used for inflation or deflation of an article and may be readily converted between inflating and deflating applications. More rapid inflation may be achieve by sourcing the incoming air from both the air inlet and the intake. Rapid and complete deflation may be achieved by simply interchanging the connection of the fill valve of the article between the outtake and the intake, and closing the air inlet. Accordingly, the invention provides a simple low cost accessory which enables consumer air compressors to be used for inflation and deflation of high volume, low pressure inflatable articles which is an application for which most consumer electric air compressors are not well suited.

Additional objects and advantages of the invention will be apparent from the detail description of the embodiments, the appended claims and the accompanying drawings or may be learned by practice of the invention.

BRIEF DESCRIPTION OF THE DRAWINGS

The accompanying drawings which are incorporated in, and constitute a part of, the specification, illustrate two embodiments of the invention and together with the description served to explain the principles of the invention. In the drawings, the same reference numerals indicate the same parts.

DESCRIPTION OF EMBODIMENTS

I. Device for Inflation and Deflation

Figure 1:
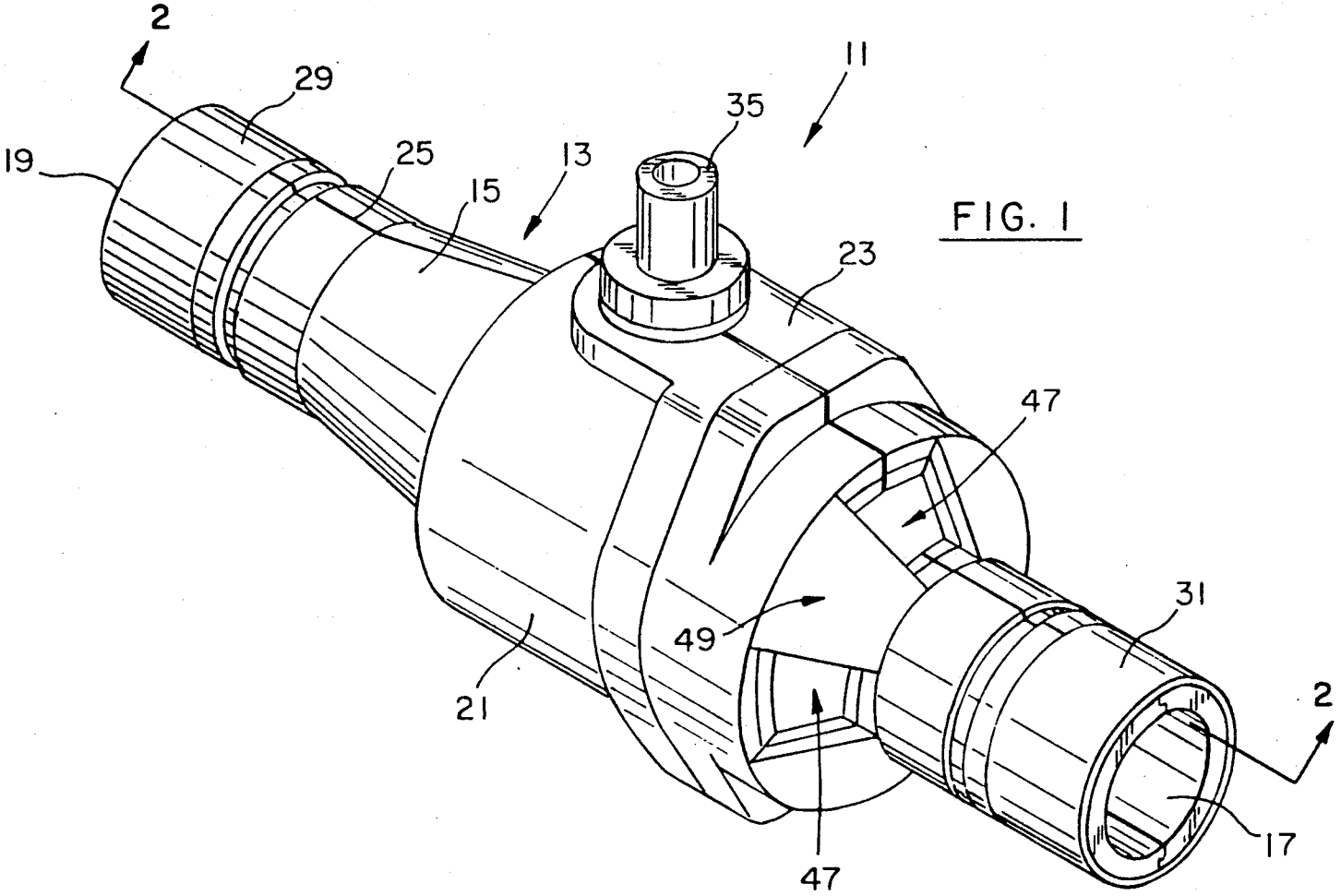
FIG. 1 is a perspective view of a preferred embodiment of a device for inflating and deflating low pressure articles in accordance with the invention herein.
Figure 2:
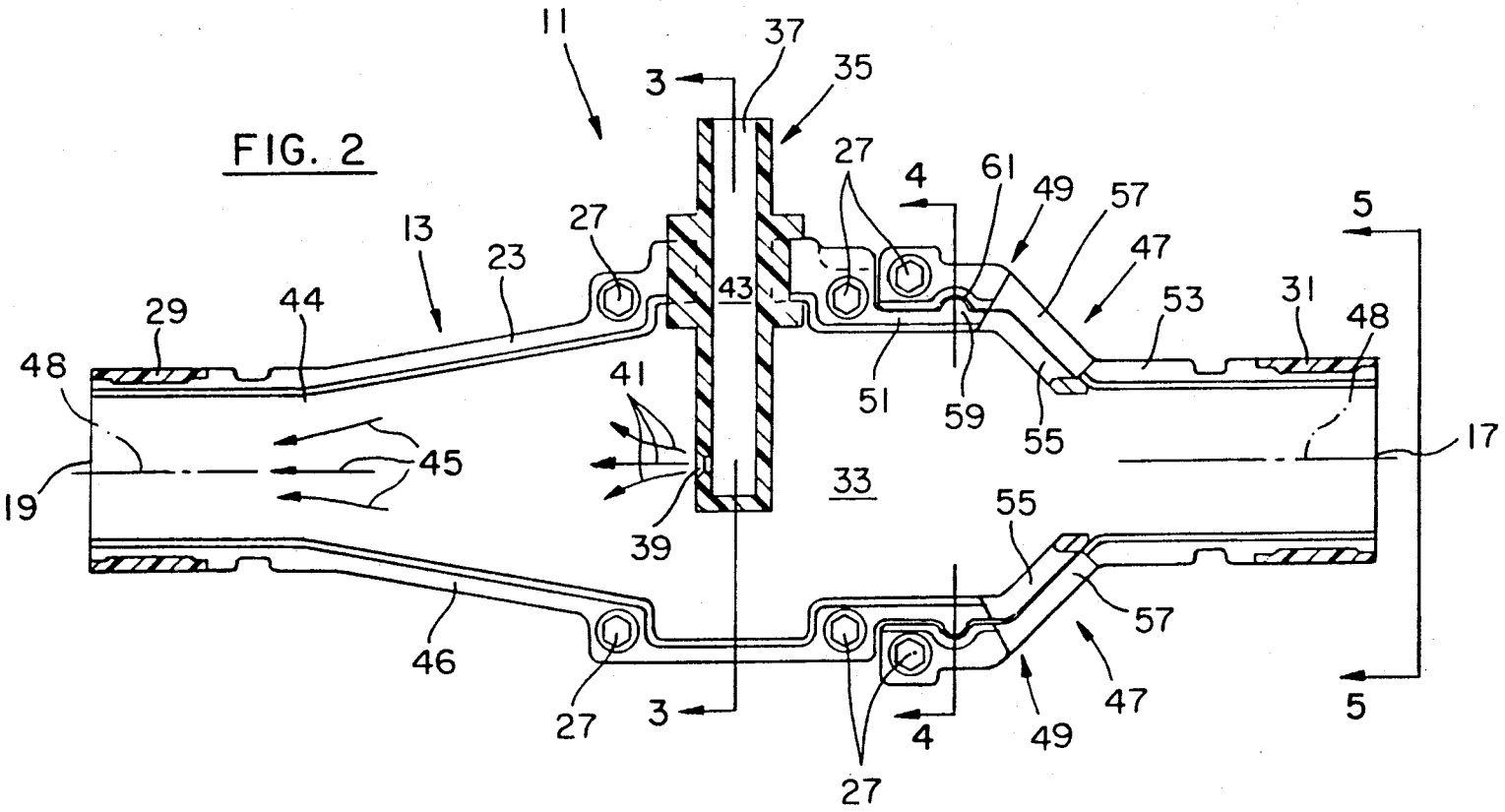
FIG. 2 is a longitudinal cross-sectional view of the device of FIG. 1 taken along line 2—2.
Figure 3:
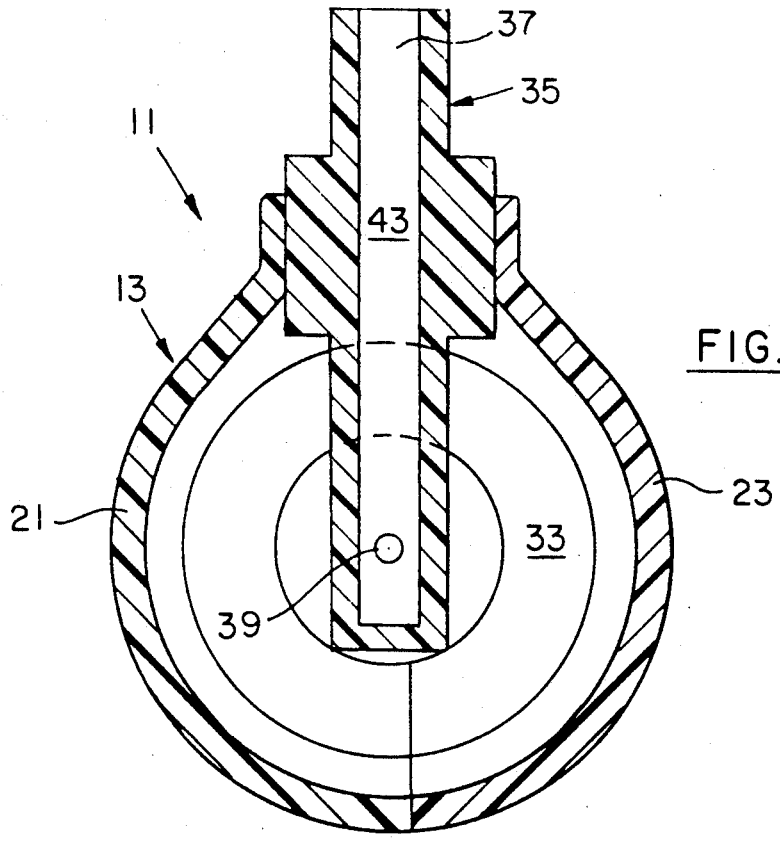
FIG. 3 is a transverse cross-sectional view of FIG. 2 taken along line 3—3.
Figure 7:
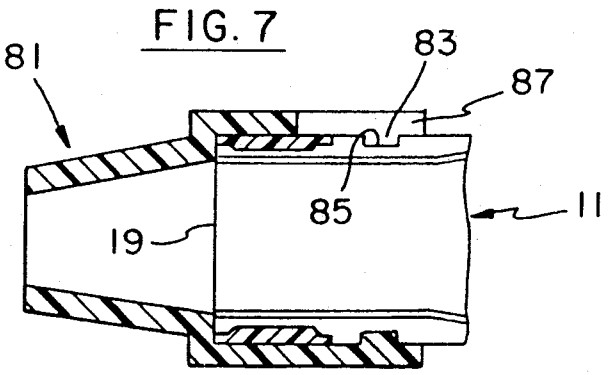
FIG. 7 is a longitudinal cross-sectional view, similar to FIG. 2, of the device with an adapter nozzle connected to the outtake for inflation of an article.
Figure 8:
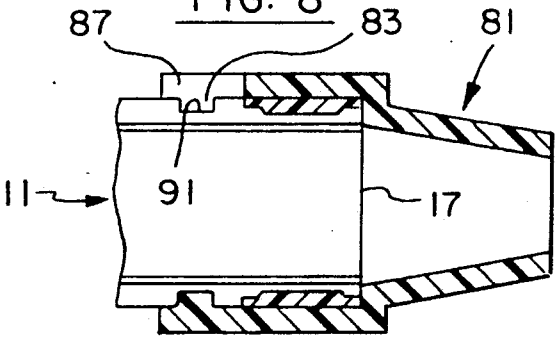
FIG. 8 is a longitudinal cross-sectional view, similar to FIG. 2, of the device with an adapter nozzle connected to the intake for use in deflation of an article.
Figure 9:
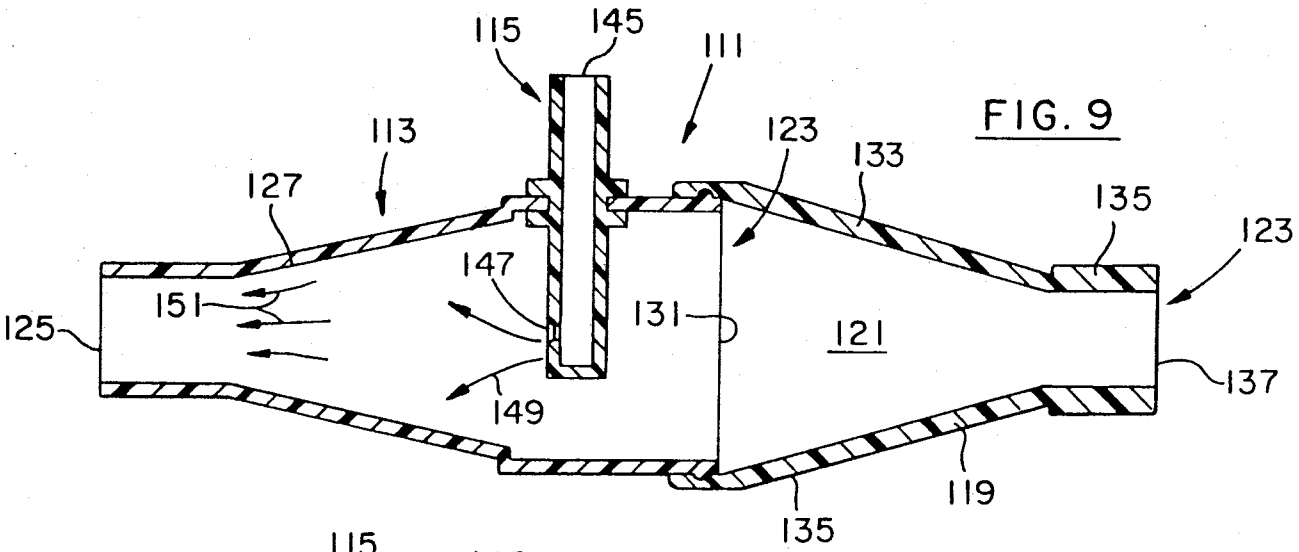
FIG. 9 is a longitudinal cross-sectional view of an alternate embodiment of a device for inflating and deflating low pressure articles in accordance with the invention herein.
Figure 10:
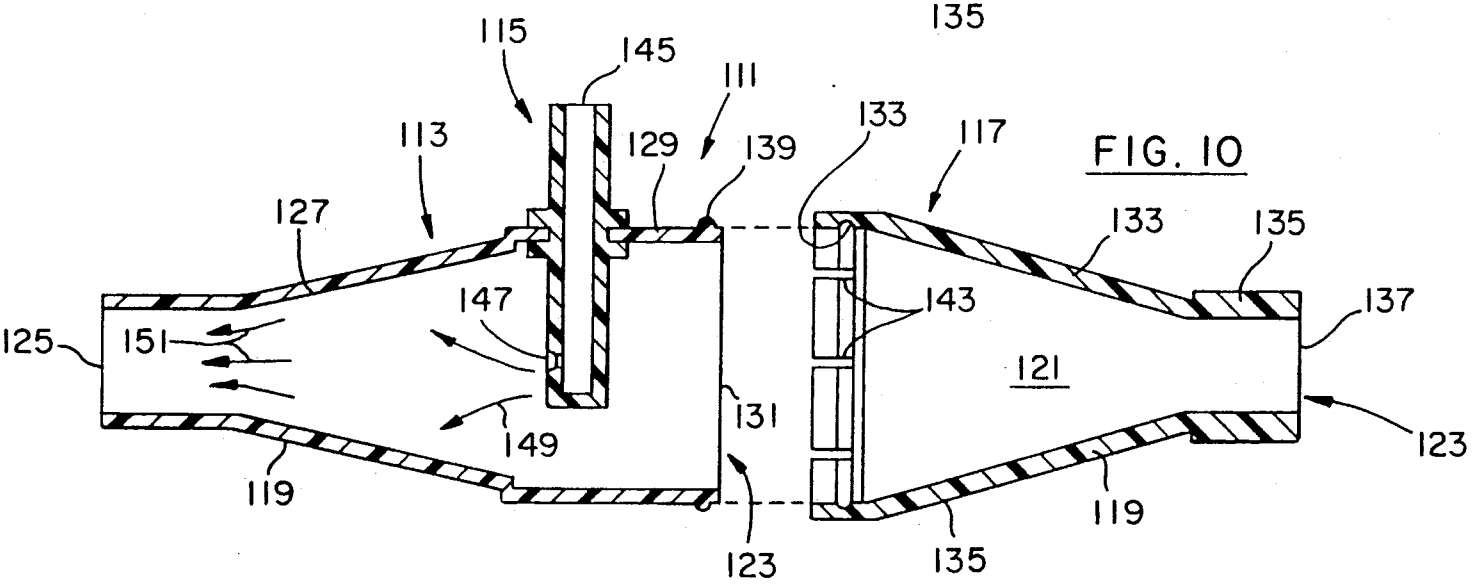
FIG. 10 is a longitudinal cross-sectional view of the device of FIG. 9 illustrating the separability of the device into two sections.

The preferred embodiment of a device 11 for inflating and deflating articles is shown in FIGS. 1 and 2. Details of the embodiment are shown in FIGS. 3-8. An alternate embodiment of a device 111 is shown in FIGS. 9, 10. In brief, device 11 comprises a conduit 13, an intake 17, an outtake 19 and an injector 35. In use, conduit 13 functions as a venturi tube for rapid inflation and deflation of inflatable articles, preferably, articles having a large volume, low pressure, air volume. For inflation, outtake 19 is connected to the inflatable article. For deflation, intake 17 is connected to the inflated article. For inflation and deflation, a source of pressurized air (not shown) is connected to injector 35.

In accordance with the invention, as depicted in FIGS. 1, 2, device 11 comprises conduit 13 having a sidewall 15, intake 17 and outtake 19. As embodied herein, conduit 13 includes a pair of halves 21, 23 joined along line 25 by a plurality of pins extending from half 23 and fitting into cavities 27 in half 21. Halves 23, 25 are also held together by a sleeve 29 fitted over the intake end of conduit 13 and by sleeve 31 fitted over the outtake end of conduit 13.

Preferably, conduit 13 is elongated and has a central passageway 33 extending between intake 17 and outtake 19 which are located at opposed ends of passageway 33.

In accordance with the invention, device 11 further comprises tubular injector 35 fixed to and extending through sidewall 15. Injector 35 has an opening 37, which is external to sidewall 15 and is connectable to a source of pressurized air (not shown), and has a small orifice 39 within conduit 13 for expelling a small volume, high velocity, low pressure air stream 41. As embodied herein an injector 35 is sized to be connectable to connectors such as a universal clamp valve and a chuck valve which are commonly used on electric air compressors and hand operated pumps. Alternatively, the outer periphery of injector 35 may be threaded for connection of an air source having a threaded connector. Pressurized air preferably from an electric compressor is blown through opening 37 and is confined in cavity 43 of injector 35 to build up a small volume of pressurized air. The air is then expelled through orifice 39 as a small volume, high velocity, low pressure air stream 41. The pressure of air stream 41 is equal to the pressure within passageway 33. Orifice 39 is located within passageway 33 coaxially of longitudinal axis 48 (FIG. 2) and is directed toward outtake 19 to generate a high volume, low pressure air stream 45 through outtake 19. A venturi throat 44 is formed at the junction of outtake 19 and frustroconical section 46. In accordance with the well known operation of a venturi tube, the diameter of orifice 39 is determined by the airflow rate of the source of pressurized air and by the distance (along axis 48) between venturi throat 44 and orifice 39. The airflow rate of air stream 45 is optimized if the velocity of air stream 41 is approximately equal to sonic velocity. Air stream 45 may be used for inflation or deflation of an article depending on the source from which the stream 45 is drawn in addition to stream 41.

Figure 4:
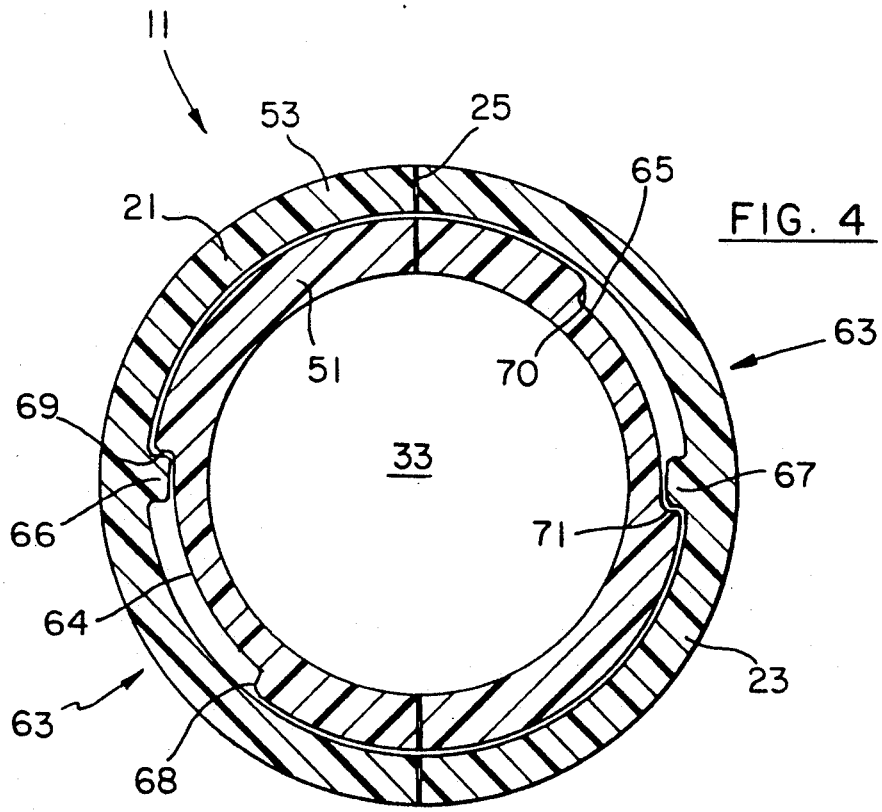
FIG. 4 is a transverse cross-sectional view of FIG. 2 taken along line 4—4.
Figure 5:
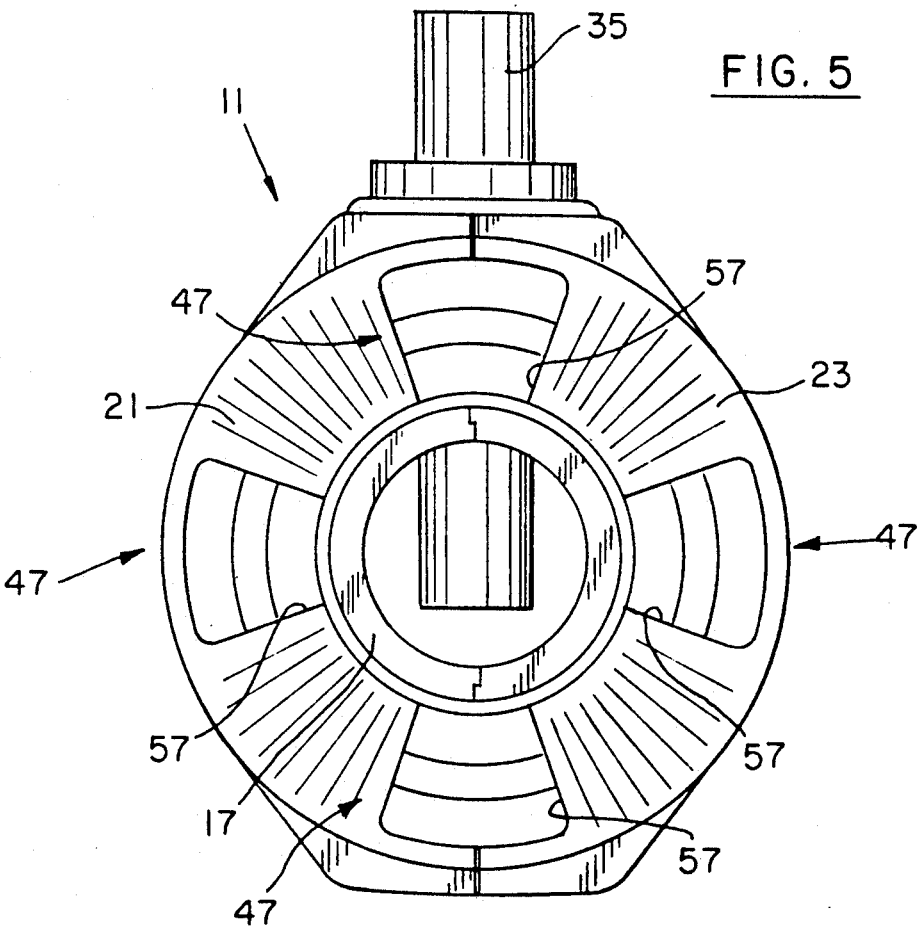
FIG. 5 is an end elevational view of FIG. 1 taken along line 5—5.

In accordance with the invention, as shown best in FIGS. 2, 4, 5 device 11 further comprises an air inlet 47 in sidewall 15 and a closure means 49 for inlet 47 movable between an opened position for permitting airflow through the inlet and a closed position for preventing airflow through the inlet. As embodied herein, closure means 49 preferably comprises a first section 51 of conduit 13 and a second section 53 of conduit 13 which coaxially overlaps first section 51 and is rotatable relative to first section 51 for opening and closing air inlet 47. Air inlet 47 preferably comprises a plurality of apertures 55 in section 51 and a plurality of apertures 57 in section 53. The number of apertures constituting inlet 47 is a matter of choice. Although it is preferred to have a separate inlet 47, as will be explained in connection with the second embodiment shown in FIGS. 9 and 10, inlet 47 and intake 17 may be combined into a single air intake and also considered to be a single air intake in the preferred embodiment. To optimize airflow through passageway 33, the open area of aligned apertures 55, 57 and inlet 17 should be approximately equal to the interior transverse cross-sectional area of passageway 33 adjacent to and upstream of injector 35 (i.e., the internal area of section 51 in the region of line 4—4).

As will be appreciated, closure means 49 may be configured in a variety of different ways. For example, air inlet 47 may be constituted by one or more fixed openings which are closable by a plug or cap closure. In the preferred embodiment when intake 17 and inlet 47 are considered in combination as an intake for conduit 13, closure 49 constitutes a means for adjusting the size of the intake opening to convert device 11 back and forth between inflation and deflation modes which are described in more detail below, particularly in Sections II and III.

To guide the relative rotation of sections 51, 53, a tongue 59 and groove 61 connection is preferably formed between sections 51, 53. To limit the relative rotation between first and second sections 51, 53 device 11 further comprises a stop 63 (FIG. 4). Stop 63 preferably comprises recesses 64, 65 formed in one of the first and second sections 51, 53 and projections 66, 67 fixed to the other of the first and second sections and slidably mounted, respectively, in the recesses 64, 65. Preferably recesses 64, 65 are formed in tongue 59 extending from first section 51 and projections 66, 67 extend from groove 61 formed in second section 53. Projections 66, 67 ride in recesses 64, 65 and limit the relative rotation of sections 51, 53 by engagement with the end walls 68–71 of recesses 64, 65 to define the open and closed positions of closure 49. The opened position is shown in FIG. 4 in which projections 66, 67 engage end walls 69, 71. In the closed position, projections 66, 67 engage end wall 68, 70. Two projections 66, 67 and recesses 64, 65 are preferred, however, one projection and recess may be used. As will be appreciated, the tongue and groove connection 59, 61 serves the dual purposes of guiding relative rotation between sections 51, 53 and also limiting the relative rotation to define the open and closed positions of air inlet 47.

Inlet 47 is used during inflation of an article to provide a source of incoming air in addition to air from intake 17. As a result, a significantly higher level of airflow may be achieved for inflation resulting in more rapid inflation of low pressure, inflatable articles. For rapid deflation of an article, inlet 47 is closed so that the entire source of air to support air stream 45 is from intake 17. As will be appreciated, device 11 is rapidly and easily converted between inflation and deflation modes merely by opening or closing inlet 47.

Figure 6:
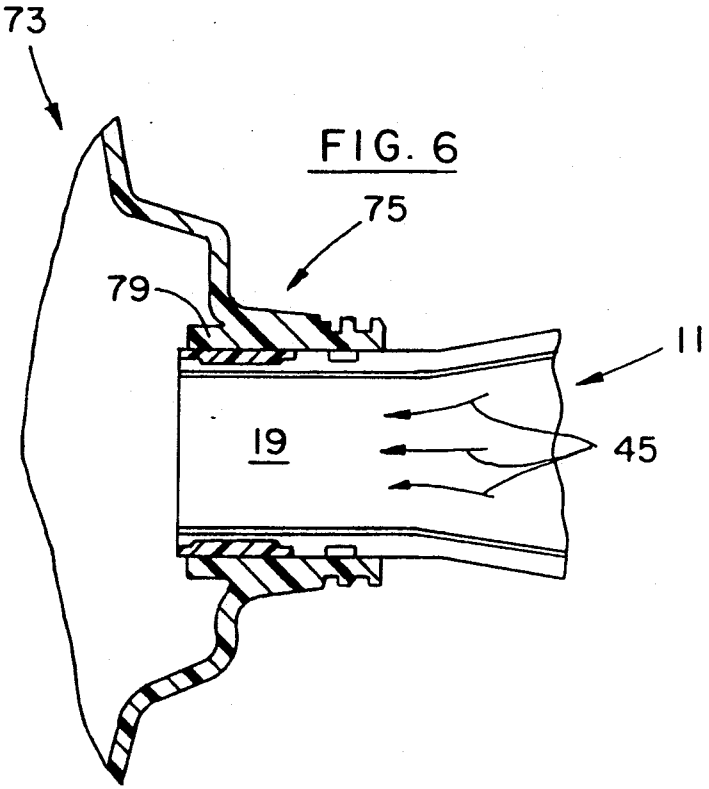
FIG. 6 is a fragmentary longitudinal cross-sectional view of the device similar to FIG. 2 except that the device is shown in use for inflation of an inflatable article.

As shown in FIG. 6 to inflate an article 73 (e.g., an air mattress) outtake 19 may be directly inserted into a fill valve 75 of article 73 until a generally air tight seal is formed between wall 79 and the outer profile of conduit 13. To provide an outer profile conducive to forming a seal, as seen in FIGS. 1 and 2, conduit 13 has a cylindrical outer wall forming outtake 19 and has frustroconical section 46 which increases in diameter toward injector 35.

To permit outtake 19 to fit within fill valves having a wide range of inner diameters, one of a plurality of adapter nozzles (not shown) may alternatively be connected to outtake 19. An exemplary adapter nozzle 81 is illustrated in FIG. 7. Nozzle 81 is preferably connected to outtake 19 by a snap fit formed by rib 83 and groove 85. To permit attachment and removal of nozzle 81, axially extending slots 87 (only one shown) are cut in the sidewall of nozzle 81 so that rib 83 may slide into and out of groove 85. Nozzle 81 terminates in an end smaller in outer diameter than the outer diameter of outtake 19 and is thus intended to fit into fill valves smaller than that depicted in FIG. 6. Nozzle 81 has been found to be particularly suitable for use with a fill valve (not shown) having a flap closure which must be pivoted away from the valve opening for inflation and deflation of the article.

A larger diameter adapter nozzle has a greater airflow than a smaller diameter adaptor nozzle. But, airflow in a large nozzle drops as pressure increases within the inflatable article more than a smaller diameter adapter nozzle. The preferred inner diameter of outtake 19 is 0.60 inches. Exemplary adapter nozzle inner diameters are 0.45 inches and 0.28 inches. The performance enhancement obtained through air inlet 47 is greater for larger outtake diameters. Significant performance enhancement is obtained for the 0.60 inch diameter outtake and for the 0.45 inch diameter adapter nozzle. For the 0.28 inch adapter nozzle, air inlet 47 does not provide an increased airflow.

For deflation, one of the plurality of adapter nozzles (not shown) of which nozzle 81 is representative is connected to intake 17 by a snap fit formed by rib 83 and groove 91 connection identical to the connection between nozzle 81 and outtake 19. Because the irregular outer profile of apertures 57 prevents a good seal from being formed between intake 17 and a fill valve, an adapter nozzle is always connected to intake 17 for deflation of an article. Nozzle 81 is fitted in the fill valve of the article to be deflated and a high volume, low pressure air stream is expelled from the article through the intake 17, is transmitted through passageway 33 and is expelled from outtake 19 as will be explained in more detail below.

An alternate embodiment of a device 111 for inflating and deflating articles in accordance with the invention is shown in FIGS. 9 and 10. In brief, device 111 comprises a conduit 113, an injector 115 and a closure means 117. Conduit 113 comprises a sidewall 119 defining a passageway 121, an intake 123 and an outtake 125. As embodied herein, a first section 127 terminates in an end 129 defining an intake 131 for inflation. A second section 133 of conduit 113 terminates in an end 135 defining an intake 137 for deflation. As shown in FIGS. 9, 10, sections 127, 133 are detachably connected together by an annular bead 139 on section 127 which snap fits into a mating annular groove 141 in section 133. Slots 143 may be formed in sidewall 119 of section 133 to permit the sidewall 119 of section 133 to flex when attaching to and detaching from section 127.

Injector 115 is preferably constructed identically to injector 35 shown in FIG. 2 and includes an external opening 145 and an orifice 147 for expelling an air stream 149.

Closure means 117 is an alternate embodiment of closure means 49 (FIG. 2) and is for adjusting the size of the intake 123 to convert device 111 back and forth between inflation and deflation modes. As embodied herein, closure means 117 is constituted by conduit section 133. Intake 123 is adjusted for inflation by detaching section 133 to expose inflation intake 131. Only section 127 is used for inflation of an article. Intake 123 is adjusted for deflation by attaching first and second sections 127, 133 together which covers inflation intake 131 and assembles deflation intake 137 in an operative condition. Intake 123 is adjustable between the sizes of intakes 131, 137 and thus is adjustable between a total open surface area approximately equal to the transverse cross-sectional area of passageway 121 adjacent to an upstream of orifice 147 and a total open surface area approximately equal to the area of the opening in the fill valve of an article to be deflated such as article 73 in FIG. 6.

As will be appreciated, the embodiment of FIGS. 9, 10 illustrates an embodiment of the invention in which a separate air inlet (comparable to inlet 47 of the preferred embodiment) is not provided and is replaced by separate intakes 131, 137 for inflation and deflation respectively.

II. Method for Inflation

The method for using device 11 to inflate a low pressure inflatable article is another important aspect of the invention. According to this aspect of the invention, as illustrated in FIG. 6, the method comprises a first step of connecting outtake 19 to a fill valve 75 of article 73. As embodied herein, article 73 may be, for example, an air mattress with a conventional fill valve 75. Outtake 19 may be directly inserted into valve 75. Or alternatively if outtake 19 has a larger diameter than the inner diameter of valve wall 79, then an adapter nozzle of an appropriate size may be fitted over outtake 19 so that a frictional air seal is provided between the outer surface of the adapter nozzle and the inner surface of wall 79. An exemplary adapter nozzle 81 is illustrated in FIG. 7.

A second step is to generate a small volume, high velocity, low pressure air stream 41 from orifice 39 toward outtake 19. As embodied herein, to generate air stream 41, a source of pressurized air (not shown) is connected to opening 37 of injector 35 using a conventional connector supplied with the air source. The pressurized air source may be a conventional hand pump or is preferably an electrical air compressor such as the model 9527 Air Station® inflator manufactured by Black & Decker (U.S.) Inc. which provides 1.0 cubic feet per minute of air at 30 pounds per square inch. When the compressor is connected to injector 35, a small volume of high pressure air is built up within cavity 43 and is expelled through orifice 39 toward outtake 19 as a small volume, high velocity, low pressure air stream 41.

A third step is to generate a high volume, low pressure air stream 45 which is taken in through intake 17 and inlet 47, is transmitted through the passageway 33 and is expelled into article 73 through outtake 19. As is well known in the operation of a venturi tube, the rapid increase in velocity of air stream 41 as it is expelled from orifice 39 causes acceleration of the air in passageway 33 to generate air stream 45.

To achieve a high volume airflow for rapid inflation of an article, air inlet 47 is opened by relative rotation of the first and second sections 51, 53 to align apertures 55, 57. Rotation of the first and second sections 51, 53 is guided by tongue 59 and groove 61 (FIGS. 2, 4). The open condition of closure 49 of air inlet 47 is shown in FIG. 4 and is defined by the engagement of projections 66, 67 with end walls 69, 71 of recesses 64, 65.

To increase the maximum pressure to which article 73 may be inflated intake 17 and air inlet 47 may be closed to increase the pressure within conduit 13. Using a 1 cfm at 30 psi air source for injector 11, article 73 may be inflated to approximately 0.1 psig. with the air inlet 47 and intake 17 in an open condition. By closing air inlet 47 and intake 17, article 73 may be inflated to approximately 5 psig. Air inlet 47 is closed by relative rotation of first and second sections 51, 53 to misalign apertures 55, 57. Intake 17 is preferably closed by covering the intake with the operator's finger. Alternatively, intake 17 may be closed by inserting a cap (not shown) over the intake.

Device 111 may be used to inflate a low pressure article by use of a method similar to that used for device 11. In the method, sections 127, 133 are detached; outtake 125 is connected to an article to be inflated; and an airstream 151 which is taken in through intake 131, is generated by airstream 149 to inflate the article.

III. Method for Deflation

The method for using device 11 to deflate a low pressure article forms another important aspect of the invention. According to this aspect, the method comprises the first step of connecting intake 17 to fill valve 75 of article 73. As embodied herein, adapter nozzle 81 is connected to intake 17 as depicted in FIG. 8 through a snap fit of rib 83 in groove 91. Nozzle 81 is then inserted into fill valve 75 of articles 73 to establish an air seal between nozzle 81 and the inner surface of wall 79 of valve 75. Alternatively, intake 17 may be configured so as to be directly insertable into valve 75 if desired.

A second step is to close air inlet 47. As explained above, air inlet 47 is closed by operation of closure 49 which as embodied herein is closed by relative rotation of first and second sections 51, 53 to misalign apertures 55, 57. When apertures 55, 57 are misaligned, projections 66, 67 are in engagement with recess end walls 68, 70. Closing inlet 47 converts device 11 from an inflator to a deflator and reduces the total opened area of conduit 13 upstream of orifice 39 from being approximately equal to the transverse cross-sectional area of passageway 33 adjacent to and upstream from injector 35 to approximately equal to the area of the opening in the fill valve of the article to be deflated. When inlet 47 is closed, only intake 17 is open. As discussed above for deflation, a properly sized adaptor nozzle 81 is preferably connected to intake 17 for deflation.

A third step is to generate a small volume, low pressure, high velocity air stream 41 from orifice 39 toward outtake 19. As embodied herein, air stream 41 is preferably generated in an identical manner to the method for inflating article 73 as explained above.

A fourth step is to generate a high volume, low pressure air stream which is expelled from article 73 through intake 17, is transmitted through passageway 33 and is expelled from outtake 19. As embodied herein, air stream 45 is generated in an identical manner to the generation of air stream 45 when inflating article 73 except that air stream 45 consists of air from air stream 41 and from intake 17 and thus does not include any air taken in from inlet 47 which is closed. Because the airflow through the passageway is more restricted during deflation than inflation, the rate for deflation is less than the rate for inflation. Thus, the deflation time is greater than the inflation time for the same article and the same pressurized air source.

Device 111 may be used to deflate an article by a method similar to that used with device 11. In the method, sections 127, 133 are attached together; deflation intake 137 is connected to the fill valve of an article to be deflated; an airstream 149 is generated by connection of an air source to injector 115; and an airstream 151, which is expelled from the article to be deflated through intake 137, is generated by airstream 149 and is expelled from outtake 125.

IV. Performance of Device

To illustrate the performance of the invention which has been optimized for use with a model 9527 Air Station Inflator ® manufactured by Black & Decker (U.S.) Inc. which provides 1.0 cubic feet per minute of airflow at 30 pounds per square inch, a prototype of device 11 was constructed as follows: inner diameter of outtake 19—0.60 inches, diameter of orifice 39—0.040 inches and the distance between orifice 39 and throat 44—1.62 inches. The prototype tested was functionally the same as the preferred embodiment depicted in FIGS. 1, 2 herein except that the air inlet in the prototype was constituted by a single large aperture. The following measurements were taken with the prototype for inflation and deflation of an air mattress (58 inches×77 inches×8 inches).

| Device Condition | Inflation/ Deflation Time (Min:Sec) | Average Airflow (cfm) |
|---|---|---|
| Inflation w/inlet 47 open | 1:38 | 12.7 |
| Inflation w/inlet 47 closed | 2:00 | 10.3 |
| Deflation w/inlet 47 closed | 2:12 | 9.4 |

As observed from the test, the inflation time is reduced by approximately 18.5% by having inlet 47 open. Also, rapid and complete deflation of the mattress was obtained.

It will be apparent to those skilled in the art that various modifications and variations can be made in the method and device of the invention without departing from the scope or spirit of the invention. Thus, it is intended that the present invention cover these modifications and variations provided they come within scope of the appended claims and their equivalents.

We claim:

1. A device for inflating and deflating inflatable articles comprising:

a conduit having a sidewall defining a passageway, an intake having an opening and an outtake;

an injector fixed to and extending through the sidewall, the injector having an opening external to the sidewall and connectable to a source of pressurized air and having a small orifice within the passageway for expelling a small volume, high velocity, low pressure air stream;

an inlet in the sidewall; and a closure for the inlet movable between an open position for permitting airflow through the inlet and a closed position for preventing airflow through the inlet.

2. The device of claim 1 wherein the intake opening is adjustable between an open surface area approximately equal to the transverse cross-sectional area of the passageway adjacent to and upstream of the orifice and a total open surface area approximately equal to the area of the opening in the fill valve of the article to be deflated.

3. The device of claim 1 wherein:

the conduit comprises first and second sections; and the closure comprises the second section of the conduit detachably connected to the first section and removable from the first section to increase the size of the intake opening and attachable to the first section to reduce the size of the intake opening.

4. The device of claim 1 wherein the closure comprises a first section of the conduit and a second section of the conduit coaxially overlapping the first section and rotatable relative to the first section for opening and closing the inlet.

5. The device of claim 4 wherein the first and second sections each have a plurality of apertures which are aligned in the open position of the closure and are misaligned in the closed position of the closure.

6. The device of claim 4 further comprising a stop for limiting relative rotation of the first and second sections to define open and closed positions of the closure.

7. The device of claim 6 wherein:

the stop comprises a slot recess formed in one of the first and second sections; and a projection pin fixed to the other of the first and second sections and slidably mounted in the recess.

8. The device of claim 4 wherein the closure comprises a tongue and groove connected between the first and second sections for guiding the relative relation of the sections.

9. The device of claim 8 wherein the tongue has a recess and the groove has a projection riding in the recess to limit the relative rotation of the sections and to define the open and closed positions of the closure.

10. The device of claim 1 further comprising an adaptor nozzle connected to the intake.

11. The device of claim 1 further comprising an adaptor nozzle connected to the outtake and having an end smaller in outer diameter than the outer diameter of the outtake.

12. The device of claim 1 wherein:

the conduit defines a passageway; and the transverse cross-sectional area of the passageway adjacent to and upstream of the injector is approximately equal to the open area of the air inlet plus the open area of the intake.

13. A method for inflating and deflating a low pressure inflatable article with a device comprising a conduit having an intake, an outtake, an injector having an opening external to the conduit and a small orifice within a central passageway of the conduit and directed toward the outtake, and an air inlet, the method comprising the steps for inflating the article of:

connecting the outtake to a fill valve of the article;

generating a small volume high velocity, low pressure air stream from the orifice toward the outtake; and generating a high volume low pressure air stream which is taken in through the intake and inlet, is transmitted through the passageway and is expelled into the article through the outtake.

14. The method of claim 13 further comprising the step for inflating the article of opening the air inlet.

15. The method of claim 14 wherein for inflating the article the air inlet is opened relatively rotating a first and second sections of the conduit to align apertures in the first and second sections.

16. The method of claim 13 further comprising the step for inflating the article of:

closing the intake and inlet to increase the pressure within the conduit and to increase the maximum pressure to which the article may be inflated.

17. The method of claim 16 wherein for inflating the article (1) the inlet is closed by relatively rotating first and second sections of the conduit to misalign apertures in the first and second sections of the conduit and (2) the intake is closed by covering the intake with a finger.

18. The method of claim 13 comprising the steps for deflating the article of:

connecting the intake to the fill valve of the article;

closing the air inlet;

generating a small volume, high velocity, low pressure air stream from the orifice toward the outtake; and generating a high volume, low pressure air stream which is expelled from the article through the intake, is transmitted through the passageway and is expelled from the outtake.

19. The method of claim 18 wherein for deflation of the article the air inlet is closed by relatively rotating a first and second sections of the conduit to misalign apertures in the first and second sections.

20. The method of claim 18 further comprising the step for deflating the article of:

inserting over the intake an adaptor nozzle for insertion into the fill valve of the article.

21. The method of claim 13 further comprising the step for deflating the article of:

converting the device from an inflator to a deflator by reducing the total open surface area of the conduit upstream of the orifice from being approximately equal to transverse cross-sectional area of the passageway adjacent to and upstream of the orifice to approximately equal to the area of the opening in the fill valve of the article to be deflated.

22. A method for inflating and deflating a low pressure inflatable article with a device comprising a conduit having an intake, an outtake, an injector having an opening external to the conduit and a small orifice within a central passageway of the conduit and directed toward the outtake and an air inlet, the method comprising the steps for deflating the article of:

connecting the intake to a fill valve of the article;

closing the air inlet;

generating a small volume, high velocity, low pressure air stream from the orifice toward the outtake; and generating a high volume, low pressure air stream which is expelled from the article through the intake, is transmitted through the passageway and is expelled from the outtake.

23. The method of claims 18 or 22 wherein for inflation and deflation of the article, the air stream from the orifice is generated by an air compressor connected to the opening of the injector.

24. The method of claims 18 or 22 wherein for deflating the article the step of closing the inlet reduces the total open surface area of the conduit upstream of the orifice from being approximately equal to transverse cross-sectional area of the passageway adjacent to and upstream of the orifice to approximately equal to the area of the opening in the fill valve of the article to be deflated.

25. A device for inflating and deflating inflatable articles comprising:

a conduit comprising a sidewall defining a passageway, an intake having an opening and an outtake;

an injector fixed to and extending through the sidewall, the injector having an opening external to the sidewall and connectable to a source of pressurized air and having a small orifice within the passageway for expelling a small volume, high velocity, low pressure air stream; and closure means for adjusting the size of the intake opening to convert the device back and forth between an inflation and a deflation mode.

26. The device of claim 25 wherein:

the conduit comprises first and second sections; and the first section of the conduit terminates in an end defining the intake for inflation and the second section terminates in an end defining the intake for deflation.

27. The device of claim 25 wherein the closure means comprises a first section of the conduit and a second section of the conduit coaxially overlapping the first section and rotatable relative to the first section for increasing and decreasing the size of the intake opening.

28. The device of claim 25 wherein the intake is adjustable between (a) a total open surface area approximately equal to the transverse cross-sectional area of the passageway adjacent to and upstream of the orifice and (b) a total open surface area approximately equal to the area of an opening in a fill valve of an article to be deflated.

29. A method for inflating and deflating a low pressure inflatable article with a device comprising a conduit having an intake, an outtake, an injector having an opening external to the conduit and a small orifice within a central passageway of the conduit and directed toward the outtake, the method comprising the step of adjusting the size of the intake to convert the device back and forth between an inflator and a deflator.

30. The method of claim 29 wherein the intake is adjustable between (a) a total open surface area approximately equal to the transverse cross-sectional area of the passageway adjacent to and upstream of the orifice and (b) a total open surface area approximately equal to the area of an opening in a fill valve of the article to be deflated.

31. The method of claim 29 wherein:

the conduit has a first section and a second section;

the intake is adjusted for inflation by detaching the second section of the conduit from the first section; and the intake is adjusted for deflation by attaching the first and second sections of the conduit.

* * * * *